United States Patent [19]

Abramson

[11] 4,103,439

[45] Aug. 1, 1978

[54] SHOE COVER AND METHOD OF MAKING SAME

[75] Inventor: Harvey J. Abramson, Tel Aviv, Israel

[73] Assignee: Metatech Corporation, Northbrook, Ill.

[21] Appl. No.: 724,008

[22] Filed: Sep. 16, 1976

[51] Int. Cl.[2] ..... A43B 1/10

[52] U.S. Cl. ..... 36/7.3

[58] Field of Search ..... 36/7.1 R, 7.1 A, 7.2, 36/7.3, 7.4, 133

[56] References Cited

U.S. PATENT DOCUMENTS

| | | | |
|---|---|---|---|
| 1,034,960 | 8/1912 | Bilger | 36/7.1 R |
| 2,860,425 | 11/1958 | Jackson | 36/7.3 |
| 2,924,029 | 2/1960 | Rosen | 36/7.1 R |
| 2,986,823 | 6/1961 | Kos | 36/7.1 R |
| 3,525,165 | 8/1970 | Randall | 36/133 |

*Primary Examiner*—Patrick D. Lawson

*Attorney, Agent, or Firm*—Benjamin J. Barish

[57] ABSTRACT

A shoe cover is described for use in dust-free and decontamination rooms, as protective rainwear, or the like, characterized in that it is made as a one-piece unit of thin, pliable, elastic material including a sole portion and a top portion formed in the shape of a foot to tightly enclose the complete wearer's shoe and to extend slightly above and to grip its upper edge, the outer face of the shoe cover being formed with a network of ribs which increase its tensile and shear strength, isolate tears, and reduce slip. Also described is a method of making the shoe cover wherein a form is dipped obliquely into a latex bath after having been coated with a coagulant, is dried, and is then stripped of the produced shoe cover.

4 Claims, 4 Drawing Figures

FIG.1
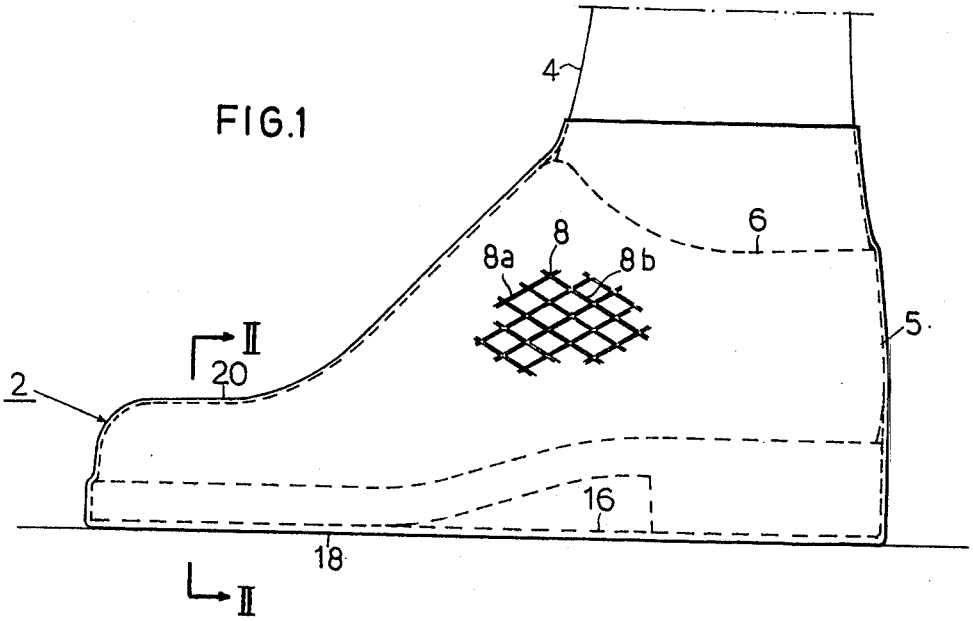
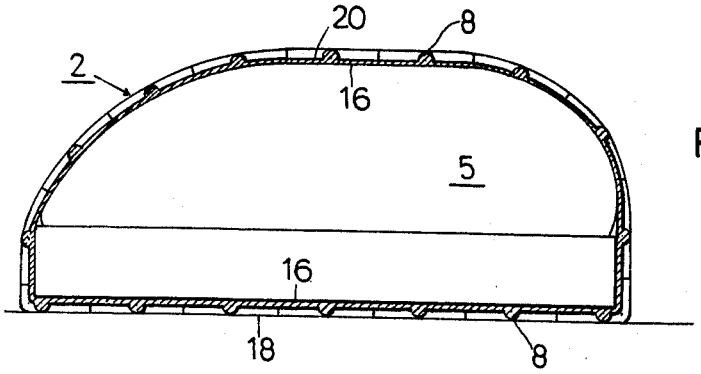
FIG.2
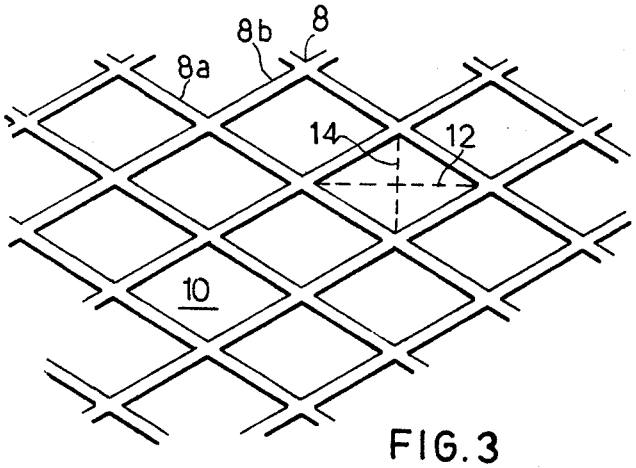
FIG.3
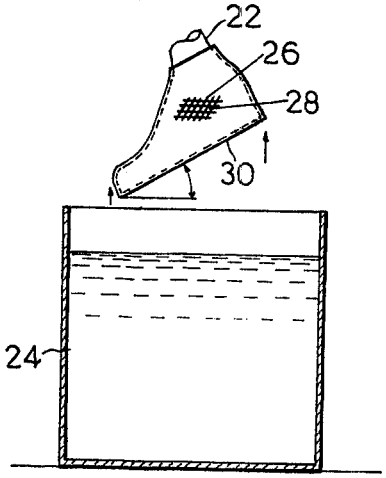
FIG.4

SHOE COVER AND METHOD OF MAKING SAME

BACKGROUND OF THE INVENTION

The present invention relates to shoe covers for use in dust-free and decontamination rooms, as protective rainwear, or the like, and also to a method of making such shoe covers.

The shoe covers now in use in dust-free and decontamination rooms are usually made of loose-fitting cloth or plastic, such as thin polyethelene sheet material. These shoe covers are not entirely satisfactory. For one thing, since they are loose-fitting, they do not completely prevent dust particles on the shoe, or between the shoe and wearer's foot, from being expelled into the air. That is to say, as the wearer walks, relative movement is produced between the wearer's shoe and the loose-fitting dust cover, causing low and high pressures to develop which inhale and exhale air from between the dust cover and the shoe or ankle. Such air contains dust particles from the wearer's shoe, foot or ankle, which particles contaminate the air. Cloth covers are porous, and therefore when used, the room may be contaminated by dust-laden air forced through the pores of the cloth cover.

The present invention provides a shoe cover having advantages in the above respects as well as the additional important advantages that it can be produced in volume, at low cost and in one size, to fit a wide range of foot sizes as well as both the left and right feet. Besides use in dust-free and contamination rooms, the shoe cover may also be used as inexpensive, light, single-size protective rainwear.

SUMMARY OF THE INVENTION

According to one aspect of the present invention, there is provided a shoe cover for use in dust-free and decontamination rooms, as protective rainwear, or the like, characterized in that the shoe cover is a one-piece unit of thin, pliable, elastic material including a sole portion and a top portion formed in the shape of a foot to tightly enclose the complete wearer's shoe and to extend slightly above and to grip its upper edge. Further, the outer face of the shoe cover is formed with a network of ribs which increase its tensile and shear strength, isolate tears, and reduce slip.

In the preferred embodiment of the invention described below, the network of ribs includes a first plurality of parallel ribs extending in one direction, and a second plurality of parallel ribs extending in another direction and intercepting the first plurality of ribs at oblique angles to form diamond-shaped sections having their long dimensions in the longitudinal direction of the shoe cover.

The sole portion of the shoe cover is preferably thicker than the top portion to maximize the stretchability of the shoe cover as a hole while at the same time providing sufficient mechanical strength and wear properties in the sole portion.

The shoe cover is made from a rubber latex by a dipping process. The mold or form, having an outer surface configured in accordance with the configuration of the shoe cover to be produced and with recesses conforming to the network of ribs on the outer face of the shoe cover, is dipped into a latex bath preferably with the sole section of the form facing downwardly and entering the bath at an oblique angle.

Further features and advantages of the invention will be apparent from the description below.

BRIEF SUMMARY OF THE DRAWINGS

The invention is herein described, by way of example only, with reference to the accompanying drawings, wherein:

FIG. 1 is a side elevational view of a shoe cover constructed in accordance with the invention applied to a wearer's foot;

FIG. 2 is an enlarged fragmentary sectional view of the shoe cover of FIG. 1;

FIG. 3 is an enlarged fragmentary plan view of the shoe cover of FIG. 1, particularly illustrating the rib network formed on its outer surface; and FIG. 4 illustrates the manner of making the shoe cover of FIG. 1 by a dipping process.

DESCRIPTION OF THE PREFERRED EMBODIMENT

FIG. 1 illustrates the shoe cover, generally designated 2, applied to a wearer's foot 4 so as to tightly enclose the complete wearer's shoe 5, and to extend slightly above and to grip its upper edge 6. The shoe cover 2 is made as a one-piece unit from thin, pliable, elastic sheet material, particularly rubber latex, preferably by a dipping process to be described below. By making the shoe cover of a rubber latex in the manner and of the configuration described below, it can be designed to provide about 600% stretchability, and therefore a single size would accommodate substantially all size shoes.

The outer face of the shoe cover is formed with a network of ribs 8. These include a first plurality of parallel ribs 8*a* extending in one direction, and a second plurality of parallel ribs 8*b* extending in another direction and intercepting the first plurality of ribs 8*a* so as to form closed parallelograms or diamond-shaped sections 10 (FIG. 3). The two groups of ribs preferably intercept each other at an oblique angle of between 45° and 60°. The closed parallelograms or diamond-shaped sections 10 formed by the ribs are so oriented that their long dimensions 12 extend in the longitudinal direction of the shoe cover and their short dimensions 14 extend in the transverse or non-longitudinal direction. As one example, the long dimension 12 may be about 15 mm, and the short dimension 14 may be about 8 mm.

It has been found that such a construction effectively increases the tensile and shear strength of the shoe cover, enabling extremely thin elastic material to be used. By having the long dimension of the diamond-shaped sections 10 extending in the longitudinal direction, stretchability is increased in the direction where needed most, ie. in the longitudinal direction. In addition, the network of ribs 8*a*, 8*b* isolates tears should one occur, and reduces slip as the wearer moves about.

Only the outer face of the shoe cover is formed with the network of ribs 8. The inner face 16 (FIG. 2) is made smooth to facilitate the application and removal of the shoe cover by the wearer. For this purpose, it would be desirable to apply a friction-reducing powder (e.g., talc) to the inner face 16 of the cover.

Preferably, the sole portion 18 of the shoe cover is made thicker than the remainder or top portion 20. As one example, the sole portion 18 (excluding the ribs 8) may be 1.0–2.0 mm, and the ribs may be 1.0–3.0 mm in thickness and 1.0–3.0 mm in width; and the remainder or top portion 20 (excluding the ribs 8) may be 0.1–0.5 mm in thickness, and the ribs may be 0.5–1.0 mm in thickness and 1.0–2.0 mm in width.

The shoe cover is made by dipping a mold or form into a rubber latex bath. This is shown in FIG. 4, illustrating the mold or form 22 and the rubber latex bath 24. The form 22, preferably made of porcelain, is shaped at its lower end with an outer surface configured in accordance with the shape of the shoe cover 2 to be produced and having recesses 26 defining diamond-shaped sections 28 conforming to the network or ribs 8 and diamond-shaped sections 10 on the outer face of the shoe cover. The form 22 is dipped into the latex bath 24 with the sole section 30 of the mold facing downwardly and entering the bath at an oblique angle. This angle is preferably about 30 degrees, and the form is dipped into the bath with the front of the sole section 30 entering first. It has been found that this reduces the tendency of entrapping air bubbles within the diamond-shaped sections 28 defined by the network of recesses 26.

Following are examples of methods of making the shoe cover.

EXAMPLE 1

The form 22 was first dipped for 5 seconds in a coagulant bath of the following composition:

| | |
|---|---|
| Methyl alcohol | 70 lit. |
| Acetone | 10 lit. |
| Calcium nitrate | 20 kg. |

Immediately after the form was removed from the coagulant bath (no drying is necessary), it was dipped into the rubber latex bath having the following composition:

| | |
|---|---|
| Precured latex | 100 parts by weight |
| Black dispersion | 15 parts by weight |

In preparing this bath, the black dispersion was first placed in a ball mill and ground for 48 hours, following which the latex was slowly stirred into the black dispersion. The final latex dipping compound so prepared was strained through a fine cloth and aged for 24 hours before use.

The form 22 was dipped into the above-prepared latex bath at a speed of 300 mm/min. After reaching the lowest point in the bath, the form was left to dwell for 5 seconds, and was then removed at the same speed. This procedure was repeated a second time, in which the form was left in the lowest point of the bath for only 2 seconds. The form, including its dipped coating, was placed into an air circulating oven at 70° C for 30 minutes, and was dusted with cornflour, following which the shoe cover was stripped from the form.

The shoe cover was then washed to remove the cornflour and immersed for 5 minutes in a chlorination bath of the following composition:

| | |
|---|---|
| Distilled water | 100 lit. |
| Sodium Hypochloride | 2 lit. |
| HCl (concentrated) | 0.85 lit. |

The above chlorination solution was prepared by mixing half of the water with the sodium hypochloride and the other half with the CHl and stirring the two parts together prior to use. After the shoe cover was removed from the chlorination bath, it was washed again and placed in a drying oven.

Shoe covers made according to the above procedure had a weight of about 33 grams each, with the sole portion 18 thicker than the top portion 20.

Following are additional examples of the manner of producing a thicker sole portion 18 in the shoe cover:

EXAMPLE 2

The form was dipped only partly in the latex bath so that only the sole section 30 with the surrounding edge was immersed; it was retained in this position for a dwell of 20 seconds. The dip was then continued as in Example 1, but during removal, it was stopped again in the previously mentioned upper position with the sole section 30 kept immersed for a dwell of another 15 seconds. The second dip and the remaining procedure were as described in Example 1. The weight of the shoe cover produced under this procedure was 48 grams.

EXAMPLE 3

The form was immersed in the latex bath as in Example 1, except that it was kept for 60 seconds in the lower position and for 30 seconds in the upper position; and no second dip was made. The weight of the cover so produced was 38 grams, and although lighter in weight than in Example 2, there was a more pronounced thickness difference between the sole portion 18 and the top portions 20 of the shoe cover.

EXAMPLE 4

The form was dipped as in Example 1 except that it was stopped in the upper position with the sole section 30 immersed and kept so for 120 seconds; and no second dip was made. The weight of the shoe cover so produced was 35 grams, and again there was a pronouned thickness difference between the sole and top portions of the shoe cover.

The thicker sole portion 18 may also be produced by providing a thicker coagulant coating on the sole section 30 of the form before dipping same into the latex bath, which thicker coagulant coating could also be produced by permitting the sole section 30 of the form to dwell in the coagulant bath a longer period of time than the remainder of the form.

Many other variations, modifications, and applications of the described embodiments of the invention may be made.

What is claimed is:

1. A shoe cover for use in dust-free and decontamination rooms, as protective rainwear, or the like, characterized in that the shoe cover is a one-piece unit of thin, pliable, elastic material including a sole portion and a top portion formed in the shape of a foot to tightly enclose the complete wearer's shoe and to extend slightly above and to grip its upper edge, the outer face of the shoe cover being formed with a network of ribs which increase its tensile and shear strength, isolate tears, and reduce slip, said network of ribs including a first plurality of parallel ribs extending in one direction, and a second plurality of parallel ribs intercepting the first plurality of ribs at oblique angles to form diamond-shaped sections having their long dimensions in the longitudinal direction of the shoe cover.

2. A shoe cover according to claim 1, wherein its inner face is smooth.

3. A shoe cover according of claim 1, wherein its sole portion is thicker than its top portion thereof.

4. A shoe cover according to claim 1, wherein said elastic material is rubber.

* * * * *